US007692082B2

(12) United States Patent
Abe

(10) Patent No.: US 7,692,082 B2
(45) Date of Patent: Apr. 6, 2010

(54) DRUM

(75) Inventor: Banri Abe, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 12/154,381

(22) Filed: May 22, 2008

(65) Prior Publication Data

US 2009/0013850 A1 Jan. 15, 2009

(30) Foreign Application Priority Data

May 25, 2007 (JP) ..... 2007-138995

(51) Int. Cl.
*G10D 13/02* (2006.01)

(52) U.S. Cl. ..... 84/411 R

(58) Field of Classification Search ..... 84/411 R, 84/412, 419, 420

See application file for complete search history.

(56) References Cited

U.S. PATENT DOCUMENTS

| | | | | |
|---|---|---|---|---|
| 578,198 | A | 3/1897 | Boulanger | |
| 4,060,019 | A | 11/1977 | Cordes | |
| 4,300,437 | A | 11/1981 | Hinger et al. | |
| 6,700,044 | B1 * | 3/2004 | Bencomo, Jr. | 84/411 R |
| 2005/0120863 | A1 | 6/2005 | Dunnet | |
| 2005/0188816 | A1 * | 9/2005 | May | 84/411 R |
| 2006/0249005 | A1 * | 11/2006 | Rush | 84/411 R |

FOREIGN PATENT DOCUMENTS

| | | |
|---|---|---|
| JP | H8-297486 | 11/1996 |
| JP | 2001-318667 | 11/2001 |
| JP | H08-006547 | 11/2001 |

OTHER PUBLICATIONS

"Drum Parts Retrieval System", Sep. 29, 2006, http://www.yamaha.co.jp/product/drum/partslist/product/model/model.php?model_code=VENT-HOLE-PLUG.

* cited by examiner

*Primary Examiner*—Kimberly R Lockett
(74) *Attorney, Agent, or Firm*—William L. Androlia; H. Henry Koda

(57) ABSTRACT

A drum is formed using a drum shell having openings at both ends thereof, across which drumheads are stretched under tension. At least one air hole is formed at a prescribed position of the exterior surface of the drum shell, allowing air flow to occur between the inside and the outside of the drum shell. At least one tone color change member, which is composed of cloth and rubber sheets, is attached to the interior wall of the drum shell in connection with the air hole; hence, the air hole is closed by the tone color change member. Thus, it is possible to appropriately change the tone color of drum sound without substantially changing the size of the drum, which can be designed similar to any types of conventionally known drums.

7 Claims, 5 Drawing Sheets

DRUM

BACKGROUND OF THE INVENTION

1. Field of the Invention

The present invention relates to drums such as bass drums, snare drums, and marching drums.

The present application claims priority on Japanese Patent Application No. 2007-138995, the content of which is incorporated herein by reference.

2. Description of the Related Art

Drums such as bass drums, snare drums, and marching drums are each formed using a drum shell having a cylindrical shape having openings at both ends, across which drumheads are stretched under tension. When a drum is struck with a drumstick, primary sound is produced due to an impact between the drumstick and the drumhead. In a drum shell having opposite openings, across which first and second drumheads are stretched under tension, when the first drumhead is struck with a drumstick, vibration occurs by the first drumhead and is transmitted to the second drumhead by way of air inside of the internal hollow space of the drum shell, whereby the second drumhead vibrates so as to cause further vibration, which is then transmitted to the first drumhead. Therefore, the first and second drumheads repeatedly vibrate via air in the internal hollow space, thus producing secondary sound. For this reason, drum playing is realized by way of the primary sound due to an impact between the drumstick and drumhead and the secondary sound due to vibrations repeatedly transmitted between the first and second drumheads.

Conventionally, various types of drums have been developed and disclosed in various documents such as Patent Document 1 to Patent Document 4.

Patent Document 1: Japanese Unexamined Patent Application Publication No. H08-6547

Patent Document 2: U.S. Pat. No. 4,300,437

Patent Document 3: U.S. Pat. No. 4,060,019

Patent Document 4: Japanese Unexamined Patent Application Publication No. 2001-318667

FIG. 5 shows a conventional example of a snare drum 1, which includes a drum shell 2 having a cylindrical shape (having openings at both ends) and drumheads 3 that are stretched under tension uniformly applied thereto at the openings of the drum shell 2 and are supported by a drumhead support device 4.

The drum shell 2 can be composed of wooden materials, fiber-reinforced plastics (FRP), and metals, for example. It is required that the shape of the drum shell 2 be stably maintained irrespective of weather conditions and variations of tensions applied to the drumheads 3, it be formed to prevent bad tuning, and it be formed to prevent self-vibrations or self-sound-absorption.

The drumhead 3 can be formed using natural leather and synthetic resin films (composed of polyester resin, polycarbonate resin, etc.).

The drumhead support device 4 includes hoops 5 (see FIG. 2), which hold the peripheral portions of the drumheads 3 and which are engaged with the exterior surface of the drum shell 2 in proximity to its openings, clamp frames 6 engaged with the circumferential peripheries of the hoops 5, lugs 7 fixed to prescribed positions of the exterior surface of the drum shell 2, and tuning bolts 8 for interconnecting the clamp frames 6 and the lugs 7 together. When the user (or a player) rotates the tuning bolts 8 using tuning keys (not shown) so as to move the clamp frames 6 in axial directions, depressions of the clamp frames 6 applied to the hoops 5 vary so as to adjust tensions of the drumhead 3, i.e., to adjust the tone color of the snare drum 1. Reference numeral 9 designates a snappy member consisting of snares; and reference numeral 10 designates strainers for moving the snappy member 9 to come in contact with or separate from the drumhead 3.

There are two types of snare drums each having two drumheads, i.e., a first type of snare drum that has an air hole 11, i.e., a vent hole allowing the exterior surface and the interior wall of the drum shell 2 to communicate with each other, and a second type of snare drum that does not have the air hole 11. In the second type of snare drum not having the air hole 11, air pressure inside of the drum shell 2 may rapidly increase when the drumhead 3 is struck with a drumstick, so that acoustic waves occur due to the displacement of the drumhead 3 and intensely interfere with acoustic waves that are reflected at the backside of the drumhead 3, thus decreasing the volume of drum sound. The second type of snare drum suffers from slow damping of vibration; hence, it cannot produce a sharp drum sound.

In the first type of snare drum (i.e., the snare drum 1 having the air hole 11), it is possible to prevent air pressure inside of the drum shell 2 from rapidly increasing due to the air hole 11, thus weakening interference between acoustic waves; and it is possible to reduce resonating sound while securing an adequate volume of drum sound. In particular, the air hole 11 may prevent the sharpness of tone color from being degraded during a soft playing mode, in which the user softly strikes the drumhead 3 with a drumstick; and it may prevent the drumhead 3 from being accidentally destroyed in a hard playing mode, in which the user intensely strikes the drumhead 3 with a drumstick.

When the drumhead 3 of the snare drum 1 having the air hole 11 is struck with a drumstick, the drumhead 3 vibrates about the inside position of the drum shell 2 rather than the normal position of the drumhead 3 not being struck. This is because the displacement of the drumhead 3 due to striking occurs inwardly in the drum shell 2 so that air is discharged outside via the air hole 11, wherein the drumhead 3 vibrates based on the air pressure inside of the drum shell 2 below the atmospheric pressure. However, the vibration of the drumhead 3 cannot last stably, and loss of vibration energy is relatively high; hence, the vibration will be rapidly damped. This improves the sharpness of the drum sound compared with the drum sound produced by the first type of snare drum not having the air hole 11.

When air flow occurs from the outside to the inside via the air hole 11 of the drum shell 2, a rapid state transition occurs in a short time period with respect to the drumhead 3 from an unstable vibrating state to a stable vibrating state, offering a small energy loss (in which the drumhead 3 vibrates about the normal position thereof), wherein the vibration of the drumhead 3 is damped slowly; hence, it is difficult to produce an adequately sharp drum sound.

Patent Document 1 teaches a drum that is designed to solve the aforementioned drawback, wherein a check valve is attached to an air hole so as to restrict air flow from occurring only in a direction from the inside to the outside in a drum shell. The check valve blocks air flow in a direction from the outside to the inside in the drum shell; hence, it is possible to rapidly damp vibration of a drumhead, thus producing a sharp drum sound.

Patent Documents 2 to 4 teach drums whose tone colors can be varied. Patent Document 2 teaches a drum in which the depth of a drum shell is varied so as to vary air load in the drum shell, thus varying the tone color. Specifically, the drum shell is constituted of a top shell and a bottom shell that are divided in an axial direction and that are interconnected together to move close to or distant from each other. A gap is formed between the joint surfaces of the top shell and bottom shell as necessary so as to serve as an air hole. It also teaches another embodiment in which an intermediate shell is inserted between the top shell and the bottom shell, wherein gaps are formed among the top shell, intermediate shell, and bottom shell, and wherein screens for damping sound or for changing tone color are inserted into the gaps.

Patent Document 3 teaches a drum whose drum shell is constituted of two shells having different diameters, which are interconnected together via bolts so as to gradually adjust the lengths thereof, thus varying the depth of the drum shell.

Patent Document 4 teaches a drum whose drum shell is divided into first, second, and third shells that are divided in an axial direction, wherein the third shell is sandwiched between the first and second shells, and wherein drumheads are stretched across the openings of the first and second shells positioned relative to the third shell. Various sets of the first, second, and third shells are provided in terms of materials, structures, and depths and are selectively combined together so as to vary tone colors, tone pitches, low-frequency characteristics, and damping times.

The aforementioned drums disclosed in Patent Document 1 to Patent Document 4 have merits and demerits; hence, it is necessary to introduce further improvements on drums. In the drum disclosed in Patent Document 1, the check valve and a spring (for pressing the check valve to close the air hole) form a resonating system during play. In order to efficiently make air flow outside of the drum shell, it is necessary to precisely design the resonating system such that vibration pitches of the resonating system substantially match vibration pitches of the drumhead with respect to each type of drum. Hence, it is very troublesome in designing the check valve; this increases the number of check valves for use in different types of drums. The check value is provided outside of the drum shell; hence, it greatly degrades the exterior appearance of a drum.

In the drum disclosed in Patent Document 2, the top shell and the bottom shell are relatively interconnected to move close to or distant from each other by means of a slide mechanism. Similar to the drum of Patent Document 1, this drum is disadvantageous in that the slide mechanism, which is exposed outside of the drum shell, greatly degrades the exterior appearance thereof. When the top shell and bottom shell are moved close to or distant from each other so as to vary air load or air flow therein, the overall depth thereof is varied. In particular, the depth of a drum shell greatly affects performance of a drum; hence, it is inconvenient for the user to experience unexpected variations of the depth of a drum shell. In the foregoing drum in which a screen offering a damping effect or a screen for varying tone color is attached to the intermediate shell, it is very difficult to stably maintain the prescribed shape when the screen does not have a satisfactory degree of hardness; hence, there is a restriction in selecting materials for use in the screen. This drum is designed using two or three shells, which are interconnected together to move close to or distant from each other. That is, this drum structure may be suited to drums whose drum shells have relatively large depths, such as marching drums, whose drum shells generally have depths of about 12 inches. But it is not suited to other drums whose drum shells have relatively small depths, such as snare drums, whose drum shells generally have depths of about 5.5 inches.

Similar to the drum of Patent Document 2, the drum of Patent Document 3 is disadvantageous in that the depth of the drum shell thereof gradually varies.

The drum of Patent Document 4 suffers from drawbacks in custody, maintenance, and transportation because various types of shell members having different materials and structures must be provided therefor.

SUMMARY OF THE INVENTION

It is an object of the present invention to provide a drum whose tone color can be varied without changing the size and depth of a drum shell.

According to the present invention, a drum is formed using a drum shell having openings at both ends thereof, across which drumheads are stretched under tension. The present invention is characterized in that at least one air hole is formed at a prescribed position of the exterior surface of the drum shell so as to allow air flow to occur between the inside and the outside of the drum shell and is closed by at least one tone color change member.

The tone color change member can be composed of an elastic material, a non-elastic material, an air-transmitting material, and a non-air-transmitting material, for example. The tone color change member is detachably attached to the interior wall of the drum shell in connection with the air hole.

In the above, the drum shell can be constituted of a first shell and a second shell that are divided in an axial direction and that are interconnected together by means of a plurality of lugs, thus forming the air hole therebetween.

The present invention offers the following effects.

Since the tone color change member is attached to the air hole to produce a load to air flow, it is possible to appropriately change the tone color of a drum sound without substantially changing the depth of the drum shell.

By appropriating selecting the material for the tone color change member from among the elastic material, non-elastic material, air-transmitting material, and non-air-transmitting material, it is possible to produce various tone colors in drum sound.

By simply removing the tone color change member, the drum of the present invention can serve as a normal drum having an air hole. When the tone color change member is composed of the non-air-transmitting material, the drum of the present invention can serve as a normal drum not having an air hole.

Since the tone color change member is attached to the interior wall of the drum shell, it does not degrade the exterior appearance of the drum.

In this connection, the air hole can be interpreted in a broad range of meaning; hence, it can be regarded as a hole, a cutout, a recess, and a gap, for example.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

The present invention will be described in further detail by way of examples with reference to the accompanying drawings.

1. First Embodiment

Figure 1:
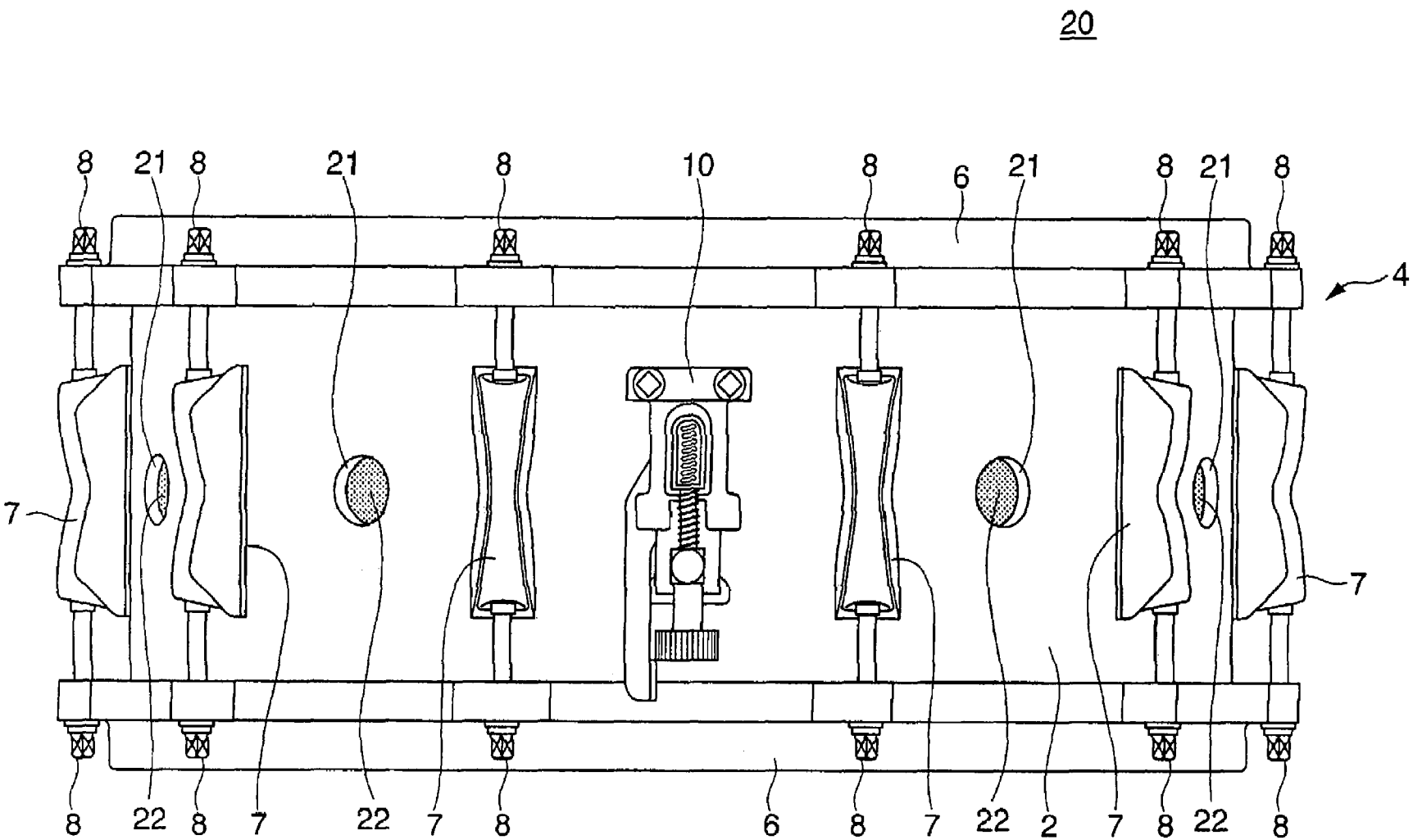
FIG. 1 is a front view showing the exterior appearance of a snare drum in accordance with a first embodiment of the present invention.
Figure 2:
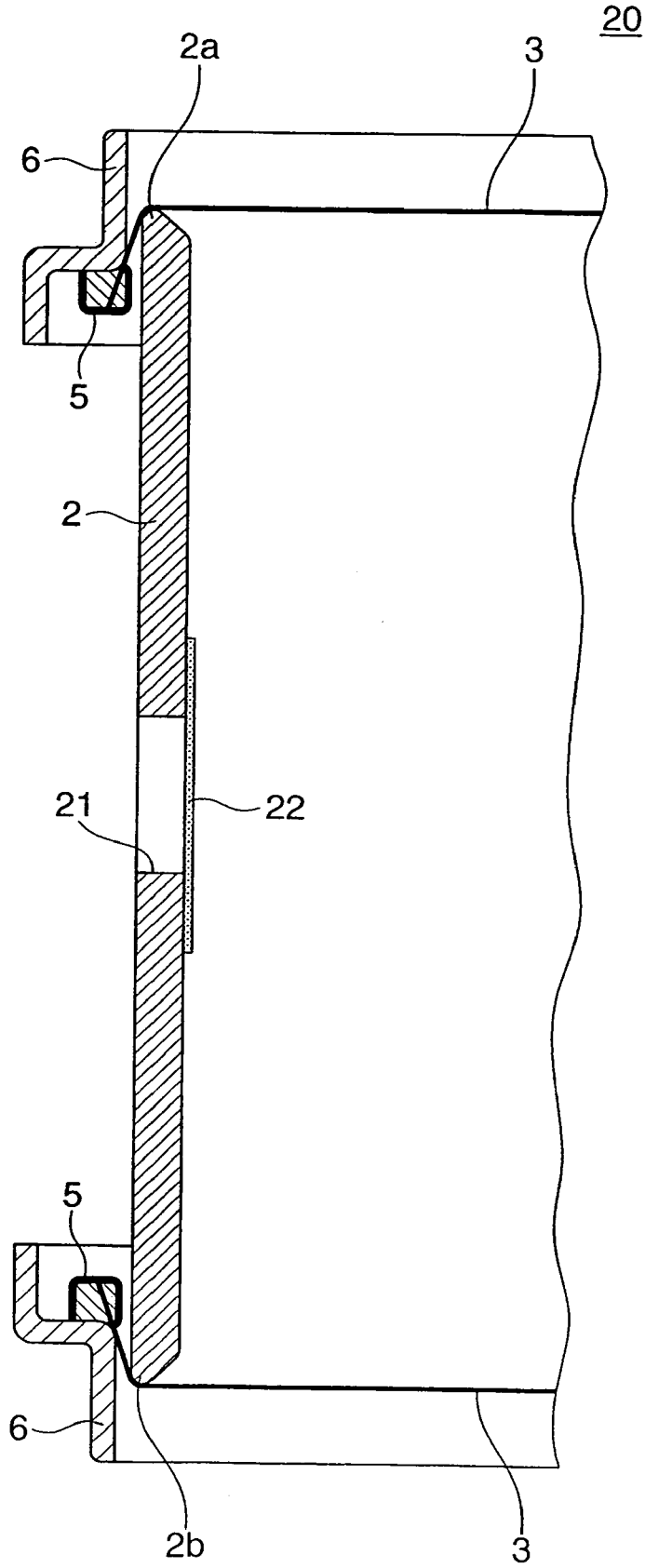
FIG. 2 is an enlarged cross-sectional view showing essential parts of the snare drum shown in FIG. 1.
Figure 5:
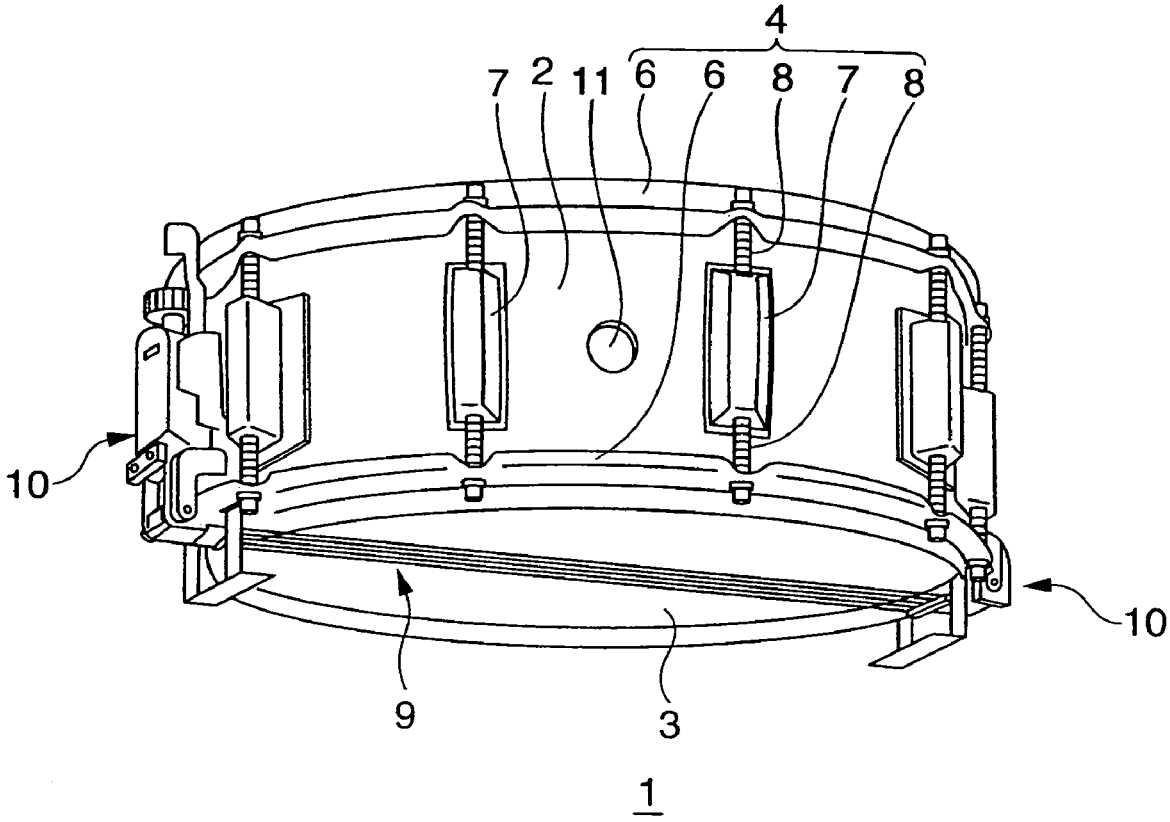
FIG. 5 is a perspective view showing the exterior appearance of a conventionally-known snare drum.

FIG. 1 is a front view of a snare drum 20 in accordance with a first embodiment of the present invention, and FIG. 2 is an enlarged cross-sectional view showing essential parts of the snare drum 20, wherein parts identical to those shown in FIG. 5 are designated by the same reference numerals.

The overall constitution of the snare drum 20 is basically identical to that of the snare drum 1 shown in FIG. 5 except that tone color change members 22 are fixed to air holes 21, which are formed at prescribed positions on the exterior surface of the drum shell 2 having a cylindrical shape and which establish communications between the inside and the outside of the drum shell 2. In the snare drum 20 of the first embodiment, the air holes 21 are formed in the circumferential direction of the drum shell 2 with prescribed distances therebetween. Of course, it is possible to modify the snare drum 20 to provide only a single air hole 21. It is possible to appropriately change the sizes of the air holes 21 based on the size of the drum shell 2 and the number of the air holes 21.

The tone color change members 22 are detachably attached to the interior wall of the drum shell 2 so as to close the air holes 21 by means of appropriate fixing means such as double-sided adhesive tapes, adhesive agents, screws, and band-shaped elastic rings. As the tone color change members 22, it is possible to use any types of members capable of changing tone colors, such as elastic members, non-elastic members, air transmittable members, and non air transmittable members. For example, it is possible to use rubber sheets and soft sheets composed of plastics as elastic members and non-air-transmittable members; it is possible to use wooden boards and metal plates as non-elastic members; and it is possible to use cloth, felts, and netted materials such as nonwoven fabrics as air-transmittable members.

When the air holes 21 are closed by the tone color change members 22, air flow and air load may be varied due to the tone color change members 22 in the drum shell 2 during play. Therefore, it is possible to achieve an outstanding feature for changing the tone color of a drum sound without changing the depths and materials of shells, which is not realized by the foregoing drums disclosed in Patent Document 2, Patent Document 3, and Patent Document 4.

When cloth is used for the tone color change members 22, for example, it is possible to produce "coherent" drum sound, which is damped rapidly while naturally suppressing the variation of the drumhead 3 during play of the snare drum 20. This is because the tone color change member 22 may slow down the air flow via the air holes 21 so that variations of air load can be suppressed in the drum shell 2.

That is, the first embodiment offers a simple structure of a drum, which is not substantially different from conventionally-known drums, wherein it is unnecessary to change the depth of the drum shell 2; hence, it does not affect performance by the player.

By changing the number of air holes 21 and the sizes of the air holes 21, or by using multiple tone color change members 22 having different air transmittances, it is possible to subtly change the tone color due to variations of air flow and air load.

For example, there is provided a first drum having two air holes 21, which are closed by the tone color change members 22 each having air transmittance of 50%, and a second drum having a single air hole 21, which is not closed with the tone color change member 22. In this case, it is possible to produce different tone colors in the first and second drums, which differ from each other in terms of the air flow in the drum shell 2 and the speed of air passing through the air hole 21.

In addition, it is possible to produce a unique drum sound that is different from the sound of the drum of Patent Document 1. In the drum of Patent Document 1, the check valve is opened instantaneously when the drumhead is struck with a drumstick, and just after that, the check valve is closed; hence, air transmittance may be "1" or "0". In the first embodiment in which the tone color change members 22 are composed of cloth, their air transmittances may be normally set to fixed values dependent upon weaves and materials. For this reason, the first embodiment basically differs from the drum of Patent Document 1 in terms of pressure variations in the drum shell 2; hence, it is possible to produce different tone colors. In addition, the first embodiment does not need movable members such as valves; hence, it does not produce noise due to resonance.

When rubber sheets whose air transmittance is 0% are used as the tone color change members 22, they may completely close the air holes 21; hence, the first embodiment may serve as a drum not having the air hole 21. In this case, air pressure inside of the drum shell 2 rapidly change when the drumhead 3 is struck with a drumstick, acoustic waves (which occur due to the displacement of the drumhead 3) and other acoustic waves (which occur due to reflection at the drumhead 3) greatly interfere with each other and cancel each other out, thus decreasing the volume of drum sound. In addition, it achieves slow damping of vibration of the drumhead 3; hence, it is possible to produce a dull or dead tone color of a drum sound.

Since the tone color change members 22 are attached to the interior wall of the drum shell 2, they do not degrade the exterior appearance of the snare drum 20. In order to change the tone color change members 22 with other members, the user operates tuning keys (not shown) so as to extract the tuning bolts 8 from the lugs 7; then, the user extracts the drumhead 3 so as to expose the opening of the drum shell 2; thereafter, the user changes the tone color change members 22 with other members.

It is unnecessary in the first embodiment to change the depth of the drum shell 2; hence, the first embodiment is preferably applied to snare drums having shallow drum shells.

2. Second Embodiment

Figure 3:
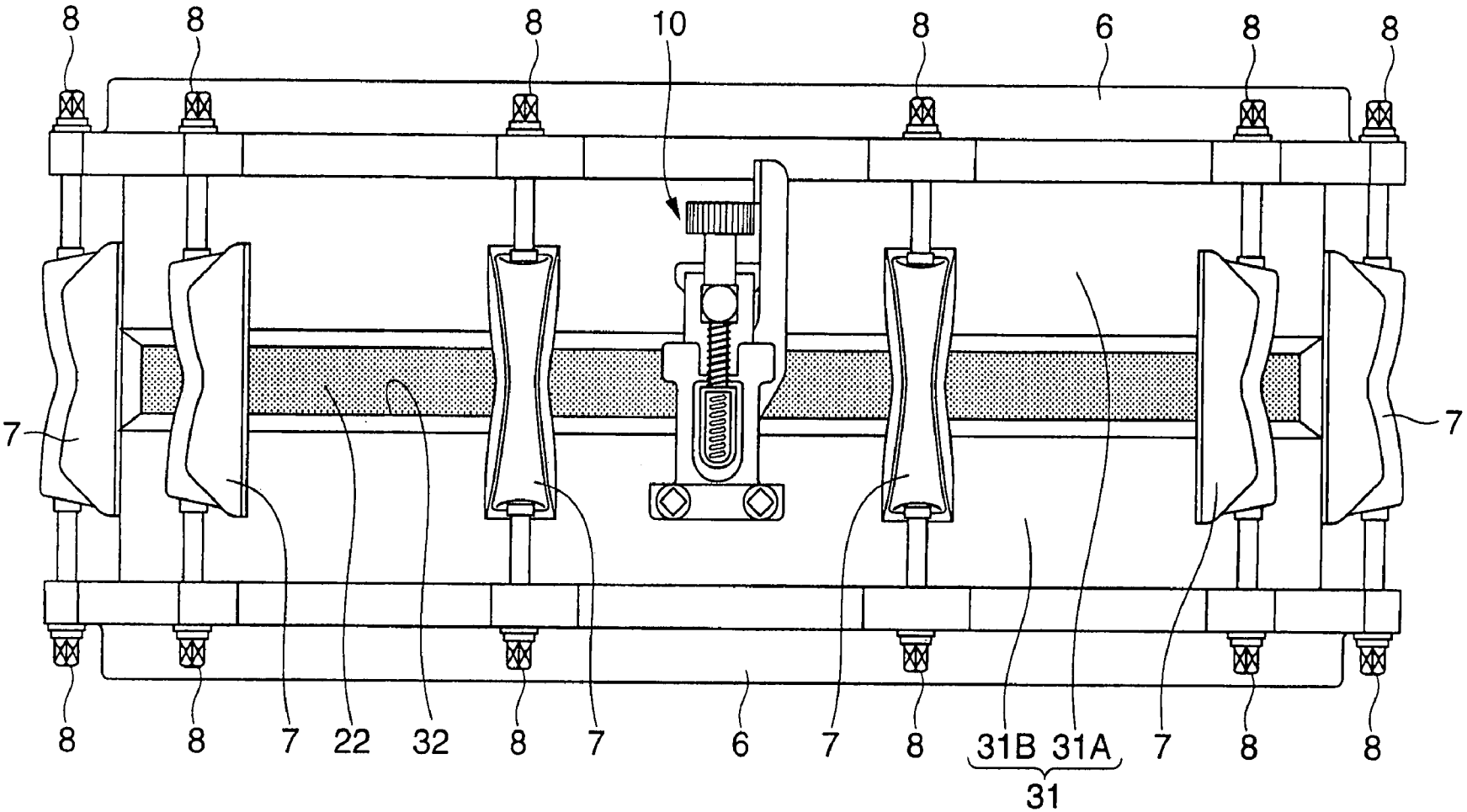
FIG. 3 is a front view showing the exterior appearance of a snare drum in accordance with a second embodiment of the present invention.
Figure 4:
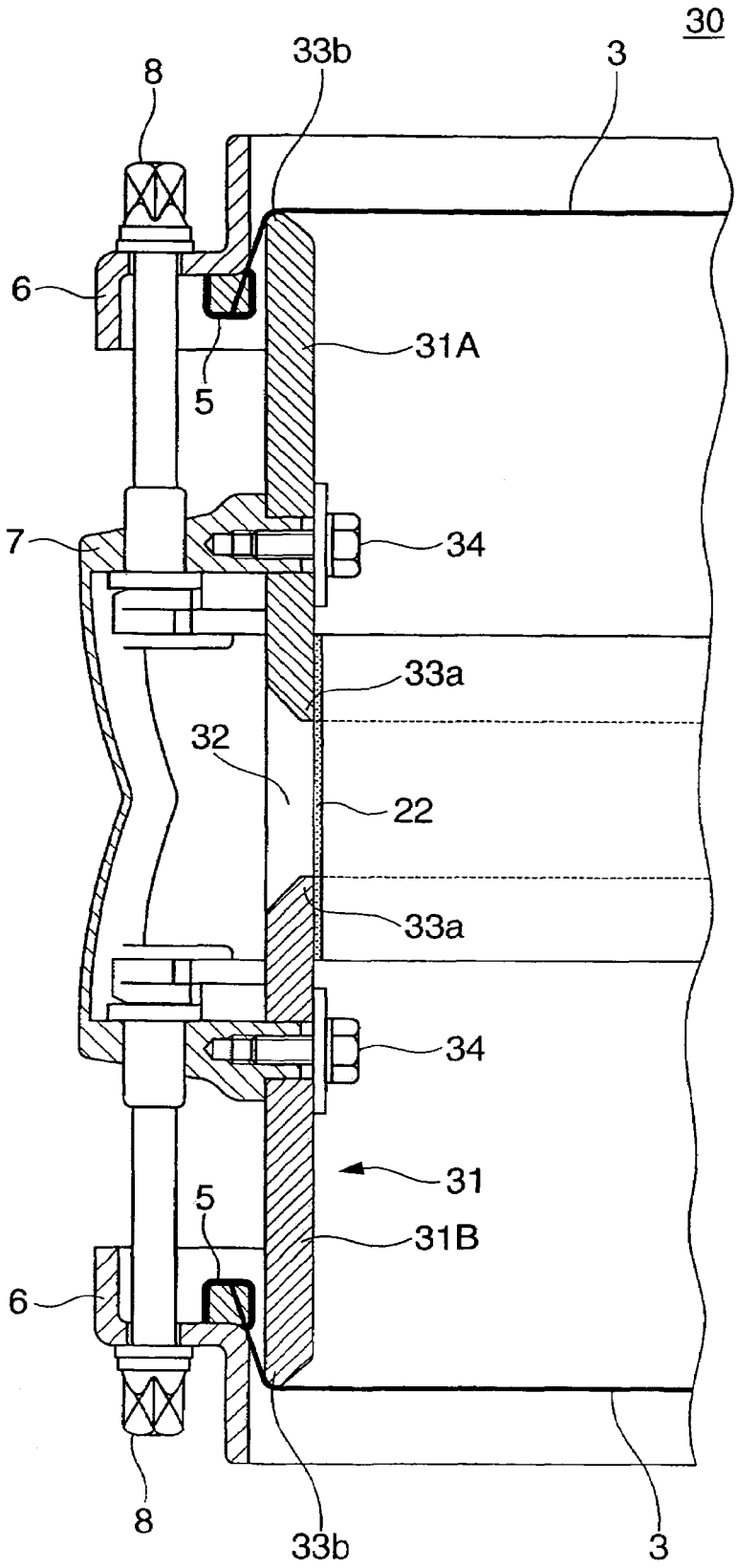
FIG. 4 is an enlarged cross-sectional view showing essential parts of the snare drum shown in FIG. 3.

FIG. 3 is a front view showing the exterior appearance of a snare drum 30 in accordance with a second embodiment of the present invention. FIG. 4 is an enlarged cross-sectional view showing essential parts of the snare drum 30 shown in FIG. 3.

The snare drum 30 is formed using a drum shell 31 constituted of shells 31A and 31B, which are divided in an axial direction. The shells 31A and 31B are interconnected together by means of a plurality of lugs 7 (each composed of one piece) and strainers 10, which are attached across openings 33*a* (positioned opposite to openings 33*b*, across which the drumheads 3 are stretched), in such a way that their axial lines substantially match each other. Distal ends of each lug 7 are attached to the exterior surfaces of the shells 31A and 31B by means of bolts 34, which are screwed inwardly to run through the shells 31A and 31B at prescribed positions. The drumheads 3 are stretched under tension on the openings 33*b* positioned opposite to the openings 33*a* across which the lugs 7 are arranged. In addition, the hoops 5 and the clamp frames 6 are engaged with the openings 33*b* so as to support and hold the peripheral portions of the drumheads 3. The clamp frames 6 are interconnected to the lugs 7 via the tuning bolts 8 so as to press the hoops 5, thus applying prescribed tensions to the drumheads 3. The distal ends of each lug 7 (composed of one piece) are interconnected to the tuning bolts 8 so that each lug 7 is shared by the two drumheads 3.

An air hole 32 is formed in connection with the openings 33*a* of the shells 31A and 31B. In the second embodiment, the shells 31A and 31B are interconnected together such that they are appropriately distanced from each other, thus forming a ring-shaped gap therebetween as the air hole 32; but this is not a restriction. It is possible to modify the second embodiment such that the shells 31A and 31B are interconnected with each other by completely interconnecting the openings 33*a* without forming a gap therebetween, wherein an appropriate number of cutouts or recesses are formed in at least one opening 33*a* so as to form air holes. Similar to the first embodiment, the tone color change members 22 composed of cloth, rubber sheets, and the like are attached to the interior wall of the drum shell 31 so as to cover the air hole 32.

Similar to the first embodiment, it is possible for the snare drum 30 to appropriately change the tone color without changing the depth and size of the drum shell 31 by changing the number and size of the air hole(s) 32, by changing materials and air transmittances of the tone color change members 22.

By appropriately changing the colors and qualities of the tone color change members 22, it is possible to improve the originality and design with regard to the exterior appearance of a drum.

The first and second embodiments are adapted to snare drums; but this is not a restriction; hence, they can be applied to other types of drums such as bass drums and marching drums.

Lastly, the present invention is not necessarily limited to the first and second embodiments, which can be further modified in a variety of ways within the scope of the invention as defined in the appended claims.

What is claimed is:

1. A drum comprising:

a drum shell having openings at both ends thereof;

a plurality of drumheads stretched across the openings of the drum shell;

at least one air hole, which is formed at a prescribed position of an exterior surface of the drum shell, allowing air flaw to occur between inside and outside of the drum shell; and at least one tone color change member that is detachably fixed to an interior surface of the drum shell in connection with at least one air hole provided in the drum shell.

2. A drum according to claim 1, wherein the tone color change member is composed of an elastic material.

3. A drum according to claim 1, wherein the tone color change member is composed of a non-elastic material.

4. A drum according to claim 1, wherein the tone color change member is composed of an air-transmitting material.

5. A drum according to claim 1, wherein the tone color change member is composed of a non-air-transmitting material.

6. A drum comprising:

a drum shell having openings at both ends thereof;

a plurality of drumheads stretched across the openings of the drum shell;

at least one air hole, which is formed at a prescribed position of an exterior surface of the drum shell, allowing air flow to occur between inside and outside of the drum shell; and at least one tone color change member that is fixed in connection with the air hole; and wherein the drum shell is constituted of a first shell and a second shell that are divided in an axial direction and that are interconnected together by means of a plurality of lugs, thus forming the air hole therebetween.

7. The drum according to claim 1, wherein said drum is a snare drum.

* * * * *